US005886282A

United States Patent [19]

Dyben

[11] Patent Number: 5,886,282

[45] Date of Patent: Mar. 23, 1999

[54] ELECTRICAL MODEL ROCKET IGNITOR AND METHOD OF MANUFACTURING THE SAME

[75] Inventor: Jerry F. Dyben, 541 Kirkmore Dr., New Haven, Ind. 46774

[73] Assignee: Jerry F. Dyben, New Haven, Ind.

[21] Appl. No.: 6,331

[22] Filed: Jan. 13, 1998

Related U.S. Application Data

[62] Division of Ser. No. 801,486, Feb. 18, 1997, Pat. No. 5,780,765.

[51] Int. Cl.[6] ..... F42C 19/12

[52] U.S. Cl. ..... 102/202.9; 102/202.11; 102/202.7; 102/202.12; 102/275.6; 102/275.11

[58] Field of Search ..... 102/202.4, 202.7, 102/202.9, 202.11, 202.12, 275.11, 275.6, 275.12

[56] References Cited

U.S. PATENT DOCUMENTS

| | | | |
|---|---|---|---|
| 1,801,163 | 4/1931 | Ketcham | 102/275.11 |
| 3,037,453 | 6/1962 | Cook et al. | 102/200 |
| 3,615,287 | 10/1971 | Adair | 102/202.11 |
| 3,717,096 | 2/1973 | Ward | 102/202.11 |
| 3,783,788 | 1/1974 | Hayashi | 102/202.11 |
| 4,049,369 | 9/1977 | Shaffer | 102/202.4 |
| 4,311,096 | 1/1982 | Oswald | 102/202.13 |
| 4,331,078 | 5/1982 | Habbel et al. | 102/202.12 |
| 4,331,079 | 5/1982 | Bajohr et al. | 102/202.12 |
| 4,939,993 | 7/1990 | Curutchet et al. | 102/202.11 |
| 5,024,158 | 6/1991 | Kennedy et al. | 102/202.12 |
| 5,070,789 | 12/1991 | True et al. | 102/275.12 |
| 5,410,966 | 5/1995 | Dorffler et al. | 102/202 |
| 5,509,354 | 4/1996 | Dorffler et al. | 102/202.11 |

FOREIGN PATENT DOCUMENTS

| | | | |
|---|---|---|---|
| 0313911 | 10/1988 | European Pat. Off. | 102/202.11 |

*Primary Examiner*—Peter A. Nelson
*Attorney, Agent, or Firm*—Taylor & Associates, P.C.

[57] ABSTRACT

The invention is directed to an electrical ignitor for a model rocket, including two insulated lead wires, with each lead wire having an uninsulated end. An element wire interconnects the uninsulated ends from each lead wire. The element wire forms a plurality of turns around one of the insulated lead wires. A pyrogen compound surrounds the element wire.

14 Claims, 2 Drawing Sheets

ELECTRICAL MODEL ROCKET IGNITOR AND METHOD OF MANUFACTURING THE SAME

This is a division of application Ser. No. 08/801,486, filed Feb. 18, 1997, now U.S. Pat. No. 5,780,765.

BACKGROUND OF THE INVENTION

1. Field of the Invention

The present invention relates to ignitors for model rockets, and, more particularly, electrical ignitors for model rockets.

2. Description of the Related Art

Model rockets include a motor made from a solid propellant which is ignited to cause the model rocket to be propelled into the air. It is known to use an electrical ignitor to ignite the solid propellant. Such an electrical ignitor includes a pair of lead wires which are connected to a tiny printed circuit board. A nichrome wire forming a small loop at the distal end of the ignitor includes opposing ends which are soldered to the printed circuit board. Because of the physical position of the nichrome wire at the end of the ignitor, the ignition event (i.e., combustion of the solid propellant) occurs at the end of the ignitor. A problem with this is that the ignitor may be shot out of the rocket by the ignition event. This is similar to the movement of a piston in a cylinder.

Another problem with a conventional electrical ignitor is that the nichrome is an alloy of nickel, chrome and iron with a melting point of about 2500 degrees Fahrenheit. The nichrome wire cannot be soldered with a regular rosin core solder. A special flux with hydrochloric acid must be used, which may pose health concerns. Moreover, such a solder connection is generally mechanically weak. Yet another problem with using nichrome wire is that its melting point is high enough that it may continue to drain the battery connected to the ignitor after the rocket launch has been completed.

What is needed in the art is an electrical ignitor with an element wire that is solderable and does not drain an attached battery after ignition. The ignitor should not be propelled out of the rocket by the ignition event.

SUMMARY OF THE INVENTION

The present invention provides an electrical model rocket ignitor and a method of manufacturing an electrical model rocket ignitor.

In The invention comprises, in one form thereof, an electrical ignitor for a model rocket, including two insulated lead wires, either twisted or duplex, with each lead wire having an uninsulated end. An element wire interconnects the uninsulated ends from each lead wire. The element wire forms a plurality of turns around one of the insulated lead wires. A pyrogen compound surrounds the element wire.

An advantage of the present invention is that the ignition event does not occur at the end of the ignitor. This inhibits the ignitor from being shot out of the rocket upon ignition.

Another advantage is that the element wire alloy can be soldered directly to copper wire with regular rosin core 60/40 tin/lead solder.

Yet another advantage is that the element wire alloy has a lower melting point. The initial current surge vaporizes the element wire and creates an open circuit. No more current then flows from the battery.

A further advantage is that the element wire alloy has a higher thermal conductivity. This allows the ignition event to occur at the mid-point of the element wire rather than at an end of the element wire.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
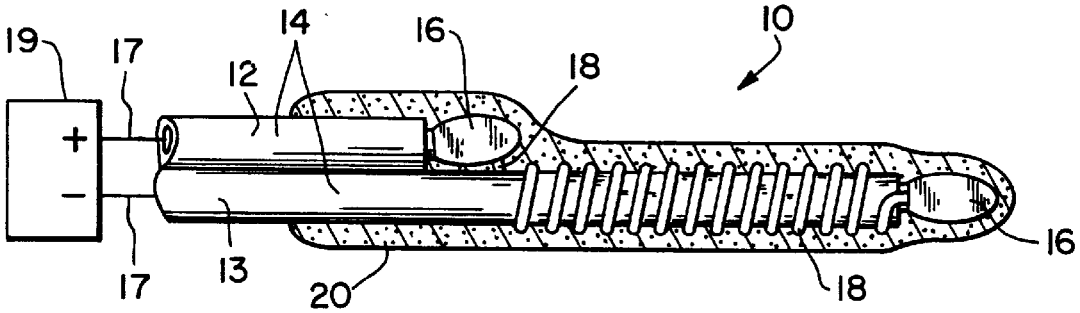
FIG. 1 is a side, sectional view of one embodiment of an electrical rocket ignitor of the present invention, with the pyrogen compound cut-away so that the wires may be viewed.

Referring now to the drawings and particularly to FIG. 1, there is shown an electrical rocket ignitor 10 including a pair of lead wires 12 and 13, element wire 18 and pyrogen compound 20.

Figure 3:
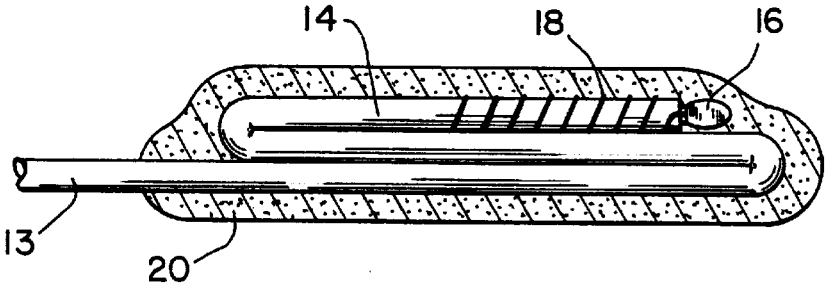
FIG. 3 is a side, sectional view of yet another embodiment of an electrical rocket ignitor of the present invention, with the lead wires folded over twice and the pyrogen compound cut-away so that the wires may be viewed.

Lead wires 12 and 13 are covered with a layer of insulation 14. Each lead wire 12 and 13 is stripped of insulation 14 at both ends 16 and 17. Lead wires 12 and 13 are twisted together to provide mechanical coupling. Alternatively, lead wires 12 and 13 may run side-by-side, held together by common insulation 14 (FIGS. 1 and 3). One uninsulated end 17 from each lead wire 12 and 13 is connected to a corresponding terminal block which is connected to a battery 19. At the opposite ends 16 of lead wires 12 and 13, lead wire 13 extends past lead wire 12 by between approximately ½ and 1 inch. Lead wire 13 thus defines an extended lead wire and lead wire 12 defines an unextended lead wire. The length of each lead wire 12 and 13 is typically between approximately 12 and 36 inches. The thickness of each lead wire 12 and 13 is between approximately 22 and 30 gauge.

Element wire 18 is soldered to and interconnects end 16 of extended lead wire 13 and end 16 of unextended lead wire 12. Element wire 18 is wrapped around wire ends 16 to form a secure connection for soldering. Element wire 18 also forms a plurality of turns around the portion of lead wire 13 that extends past lead wire 12. Between approximately 6 and 14 turns of element wire 18 span approximately 0.6 inch of lead wire 13. Element wire 18 is formed of an alloy composed of approximately 55 percent copper and 45 percent nickel with a melting point of approximately 2180 degrees Fahrenheit. Element wire 18 has a thickness of approximately 35 gauge and a resistance of approximately 9.4 ohm per foot at 68 degrees Fahrenheit. Element wire has a thermal conductivity of approximately 0.218 Watts per centimeter per degree Celsius at 100 degrees Celsius. The resistance of the series combination of lead wire 12, element wire 18 and lead wire 13 is between approximately 1.0 and 1.4 ohms.

Figure 4:
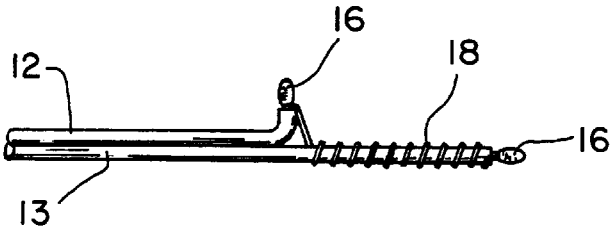
FIG. 4 is a side view of an element wire wrapped around a pair of lead wires, with the uninsulated end of the unextended lead wire being bent perpendicular to the lead wires.
Figure 5:
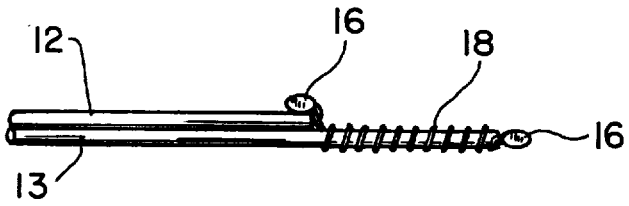
FIG. 5 is a side view of the element wire and lead wires shown in FIG. 4, with the uninsulated end of the unextended lead wire being bent 90 degrees further to point away from the extended lead wire end.

During manufacture, uninsulated end 16 of unextended lead wire 12 may be bent to form a 90 degree angle with the length of lead wires 12 and 13 (FIG. 4). This 90 degree angle bend prevents rotation of lead wires 12 and 13 during the wrapping of element wire 18 around lead wire 13. This also allows element wire 18 to be more easily wrapped around and soldered to end 16 of unextended lead wire 12 without extended lead wire 13 getting in the way. Next, element wire 18 is secured by wrapping element wire 18 around the extended portion of extended lead wire 13. Element wire 18 is then soldered to ends 16 of lead wires 12 and 13 using a rosin core 60/40 tin/lead solder. Uninsulated end 16 of unextended lead wire 12 is then bent 90 degrees further to point away from end 16 of extended lead wire 13 (FIG. 5). This last step protects element wire 18 and its solder connection to unextended lead wire 12 from physical damage.

Pyrogen compound 20 surrounds element wire 18 (FIG. 1). Pyrogen compound 20 consists essentially of VM & P naphtha, hexane, toluene, methyl ethyl ketone, resins, magnesium, titanium, acetone, ethyl acetate, isopropyl alcohol, light aliphatic solvent naphtha, 2-butoxyethanol, isobutyl isobutyrate and potassium perchlorate with Cab-o-sil. Element wire 18 and lead wires 12 and 13 are dipped in a liquid form of pyrogen compound 20 which is then allowed to harden. In another embodiment, lead wires 12 and 13 may be folded over themselves at their interconnected ends one or more times (FIG. 3). This allows more pyrogen compound to be retained on the wires upon dipping. The length of the pyrogen compound after dipping is approximately one inch and the width is between approximately 5/64 and 1/4 inch. The weight of the pyrogen compound on the electrical ignitor 10 is between approximately 0.028 and 0.283 gram.

The titanium particles within pyrogen compound 20 have been found to increase the ignition effect of pyrogen compound 20 during use. More particularly, when electrical current is applied to element wire 18 and pyrogen compound 20 is ignited, as indicated generally at reference 26 in FIG. 2, the titanium particles within pyrogen compound 20 become white hot. These white hot, melted titanium particles penetrate the surface of the solid propellent of motor 24 within the model rocket. Combustion therefore occurs at the surface as well as below the surface of the solid propellent of motor 22. This results in an improved ignition of the model rocket.

Figure 6:
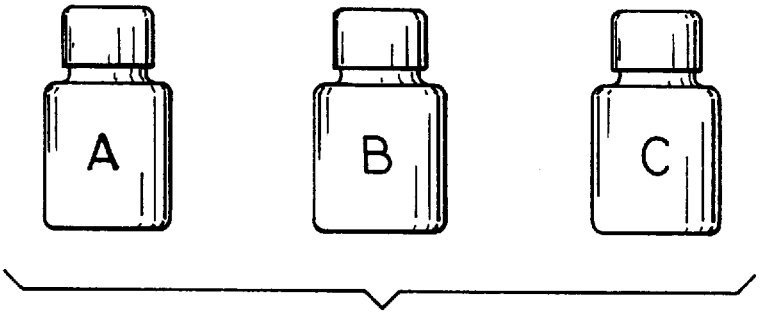
FIG. 6 illustrates a kit of three containers which contain the chemicals making up the pyrogen compound used on the electrical rocket ignitor of the present invention.

FIG. 6 illustrates a kit of three bottles A, B and C which separately carry chemicals used for making pyrogen compound 20 described above. In the embodiment of the kit shown in FIG. 6, bottle A includes 8.8 grams of plastic dip; 6.1 grams of magnesium; 2.7 grams of titanium; and 5.4 grams of lacquer thinner. The plastic dip consists of 37.0% (by weight) VM & P naphtha; 18.5% hexane; 14.8% toluene; 3.7% methyl ethyl ketone; and 26.0% resins. The magnesium is a magnesium powder, type I, grade A or B, granulation number 16-325 flake powder. The titanium is a titanium sponge powder, 100 mesh, Ti-050. Bottle B includes 17.0 grams potassium perchlorate with Cab-o-sil. The Cab-o-sil is amorphous fumed silicon dioxide used to increase the burn rate of powdered compositions by increasing their surface area. The Cab-o-sil also helps to prevent electrostatic charge buildup. The lacquer thinner consists of acetone, ethyl acetate, isopropyl alcohol, light aliphatic solvent naphtha, toluene, 2-butoxyethanol, and isobutyl isobutyrate. Bottle C includes 22.0 grams/29.4 milliliters lacquer thinner. The chemicals from bottles A and B are mixed together and used to form pyrogen compound 20. Bottle C is added in small amount to thin the pyrogen as need over time. Prior to mixing, the chemicals within bottles A, B and C conform to conditions and limitations specified in 49 CFR 173.4, et. seq.

Figure 2:
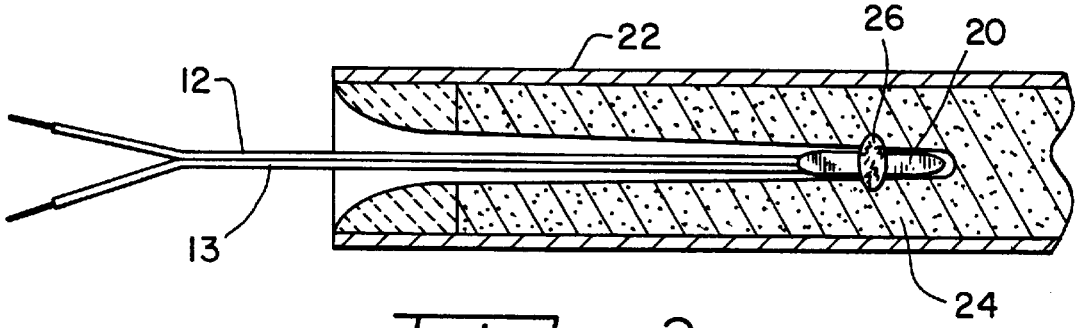
FIG. 2 is side, sectional view of a rocket motor with the electrical rocket ignitor of FIG. 1 inserted therein.

During use, electrical ignitor 10 is placed inside rocket motor 22 (FIG. 2). A battery 19 is connected across and supplies current to the series combination of lead wire 12, element wire 18 and lead wire 13. Element wire 18 is much thinner than lead wires 12 and 13 and hence heats up more quickly, carrying more current per unit area. Element wire 18, being thinner than lead wires 12 and 13, has more resistance per unit length than lead wires 12 and 13. This greater resistance results in greater power dissipation and heat in element wire 18 than in lead wires 12 and 13, all three wires carrying the same current. Element wire 18 soon creates enough heat to ignite surrounding pyrogen compound 20, as indicated at 26 in FIG. 2. The ignition of pyrogen compound 20 in turn produces the combustion of rocket motor propellant 24, resulting in a launch of the model rocket.

The relatively high thermal conductivity of element wire 18 allows element wire 18 to reach its maximum temperature somewhere near the midpoint of element wire 18, as indicated at 26 in FIG. 2. This results in an ignition event near the midpoint of element wire 18, with a portion of lead wire 13 extended past the ignition event. Thus, the ignition event places roughly equal forces of opposite longitudinal direction on lead wires 12 and 13. Lead wires 12 and 13 are thus retained in rocket motor 22 after ignition, rather than being shot out of rocket motor 22 like a piston out of a cylinder.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical ignitor for a model rocket, comprising:

two insulated lead wires disposed adjacent to each other in a side-by-side manner, each said lead wire having an uninsulated end;

an element wire interconnecting said uninsulated ends of said lead wires, said element wire being wrapped around one of said lead wires to thereby form a plurality of turns around said one lead wire; and a pyrogen compound surrounding said element wire.

2. The ignitor of claim 1, wherein said lead wires and said element wire have a combined resistance of between approximately 1.0 and 1.4 ohms.

3. The ignitor of claim 1, wherein said lead wires are twisted around each other.

4. The ignitor of claim 1, wherein said lead wires are folded over themselves at least one time at said ends, and said pyrogen compound further surrounds said folded over ends.

5. The ignitor of claim 1, wherein said lead wires have a thickness of between approximately 22 and 30 gauge.

6. The ignitor of claim 1, wherein said pyrogen compound has a length of approximately one inch.

7. The ignitor of claim 1, wherein said pyrogen compound has a width of between approximately 5/64 and ¼ inch.

8. The ignitor of claim 1, wherein said pyrogen compound has a weight of between approximately 0.028 and 0.283 grams.

9. The ignitor of claim 1, wherein between approximately 6 and 14 turns of said element wire span approximately 0.6 inch of said one lead wire.

10. The ignitor of claim 1, wherein said element wire is comprised of approximately 55 percent copper and approximately 45 percent nickel.

11. The ignitor of claim 1, wherein said element wire has a thickness of approximately 35 gauge, a resistance of approximately 9.4 ohm/foot at 68 degrees Fahrenheit, and a melting point of approximately 2180 degrees Fahrenheit.

12. The ignitor of claim 1, wherein said element wire has a thermal conductivity of approximately 0.218 Watts per centimeter per degree Celsius at 100 degrees Celsius.

13. An electrical ignitor for a model rocket, comprising:

two insulated lead wires disposed adjacent to each other in a side-by-side manner, each said lead wire having an uninsulated end;

an element wire interconnecting said uninsulated ends of said lead wires, said element wire forming a plurality of turns around one of said lead wires; and a pyrogen compound surrounding said element wire, said pyrogen compound consisting essentially of VM & P Naphtha, Hexane, Toluene, Methyl Ethyl Ketone, Resins, Magnesium, Titanium, Acetone, Ethyl Acetate, Isopropyl Alcohol, Light Aliphatic Solvent Naphtha, 2-Butoxyethanol, Isobutyl Isobutyrate and Potassium Perchlorate with Cab-o-sil.

14. The ignitor of claim 1, wherein said element wire includes a plurality of turns around a portion of said one lead wire, said portion of said one lead wire extending past the other said lead wire.

* * * * *